US009901189B2

(12) United States Patent
Hierlmeier et al.

(10) Patent No.: US 9,901,189 B2
(45) Date of Patent: Feb. 27, 2018

(54) AIR DUCT FOR REFRIGERATION CASE

(71) Applicant: Zero Zone, Inc., North Prairie, WI (US)

(72) Inventors: Bruce R. Hierlmeier, New Berlin, WI (US); William R. Geisness, Waukesha, WI (US)

(73) Assignee: Zero Zone, Inc., North Prairie, WI (US)

( * ) Notice: Subject to any disclaimer, the term of this patent is extended or adjusted under 35 U.S.C. 154(b) by 499 days.

(21) Appl. No.: 14/476,190

(22) Filed: Sep. 3, 2014

(65) Prior Publication Data

US 2015/0059387 A1 Mar. 5, 2015

Related U.S. Application Data

(60) Provisional application No. 61/873,612, filed on Sep. 4, 2013.

(51) Int. Cl.
*F24F 9/00* (2006.01)
*A47F 3/04* (2006.01)

(52) U.S. Cl.
CPC ..... *A47F 3/0408* (2013.01)

(58) Field of Classification Search
CPC ..... A47F 3/0408
USPC ..... 454/193
See application file for complete search history.

(56) References Cited

U.S. PATENT DOCUMENTS

| | | | | |
|---|---|---|---|---|
| 3,134,243 | A * | 5/1964 | Hagen | A47F 3/0447 454/193 |
| 3,468,239 | A * | 9/1969 | Straub | F24F 13/072 454/320 |
| 4,633,677 | A * | 1/1987 | Maehara | A47F 3/0447 62/256 |
| 4,696,078 | A | 9/1987 | Stromquist | |
| 6,240,739 | B1 * | 6/2001 | Hayes | A47F 3/0482 454/193 |
| 7,062,932 | B2 * | 6/2006 | Downs | A47F 3/0447 454/193 |
| 2010/0083687 | A1 * | 4/2010 | Handa | A23L 3/362 62/419 |

* cited by examiner

*Primary Examiner* — Helena Kosanovic
(74) *Attorney, Agent, or Firm* — Michael Best & Friedrich LLP

(57) ABSTRACT

A refrigeration case includes a housing having a top and a rear wall and defining an interior chamber, a door pivotably coupled to the housing opposite the rear wall and operable to selectively open and close the interior chamber, a first shelf positioned proximate a lower portion of the interior chamber, a second shelf positioned above the first shelf, a duct wall, a fan, and a diverter. The duct wall at least partially defines a flow channel extending between the first shelf and the second shelf. The duct wall includes a first opening above the first shelf and a second opening above the second shelf. The fan provides cool air flow and is in fluid communication with the flow channel. The diverter is positioned in the flow channel proximate the second shelf and directs air flow through the second opening and over the second shelf.

17 Claims, 5 Drawing Sheets

AIR DUCT FOR REFRIGERATION CASE

CROSS-REFERENCE TO RELATED APPLICATIONS

This application claims the benefit of prior-filed, U.S. Provisional Application Ser. No. 61/873,612, filed Sep. 4, 2013, the entire contents of which is incorporated by reference herein.

BACKGROUND

The present invention relates to refrigeration cases and, more particularly, to an air flow system for a refrigeration display case.

Refrigeration cases circulate air through a refrigeration coil to keep the displayed product cool. Air is typically moved through the case in a circular pattern with warm air entering an evaporator for cooling and cold air exiting the evaporator. Product disposed near the cold air outlet is often cooled to a greater extent than product that is positioned near the warm air inlet to the evaporator.

SUMMARY

In one embodiment, a refrigeration case includes a housing having a top wall and a rear wall and defining an interior chamber having an upper portion and a lower portion, a door pivotably coupled to the housing opposite the rear wall and operable to selectively open and close the interior chamber, a first shelf positioned proximate the lower portion of the interior chamber, a second shelf positioned above the first shelf, a duct wall, a fan, and a diverter. The duct wall is positioned proximate the rear wall and extends between the upper portion of the interior chamber and the lower portion of the interior chamber. The duct wall at least partially defines a flow channel extending between at least the first shelf and the second shelf. The duct wall includes a first opening above the first shelf and a second opening above the second shelf. The fan provides cool air flow and is in fluid communication with the flow channel. The diverter is positioned in the flow channel proximate the second shelf and directs air flow through the second opening and over the second shelf.

In another aspect, a refrigeration case includes a housing including a top wall and a rear wall and defining an interior chamber, a door pivotably coupled to the housing opposite the rear wall and operable to selectively open and close the interior chamber, a fan for providing cool air flow, a shelf positioned within the interior chamber proximate the top wall, a flow channel, and a return duct. The shelf includes a front end proximate the door and a rear end positioned away from the door. The flow channel has an inlet in fluid communication with the fan and circulates air flow within the interior chamber. The return duct is positioned above the shelf and includes a first portion and a second portion. The first portion includes a first return opening in fluid communication with the fan and positioned proximate front end of the shelf. The second portion includes a second opening in fluid communication with the fan and positioned proximate the rear end of the shelf.

In yet another aspect, a refrigeration case includes a housing including a top wall and a rear wall and defining an interior chamber, a door pivotably coupled to the housing opposite the rear wall and operable to selectively open and close the interior chamber, a first shelf, a second shelf, a third shelf, a fan for providing cool air flow and positioned proximate the top wall, a duct wall, a diverter, and a return duct. The first shelf is positioned proximate the lower portion of the interior chamber. The second shelf is positioned above the first shelf. The third shelf is positioned above the second shelf. The duct wall is positioned proximate the rear wall and at least partially defines a flow channel extending between at least the first shelf and the second shelf. The duct wall includes a first opening proximate the first shelf and a second opening proximate the second shelf. The diverter is positioned in the flow channel proximate the second shelf, and the diverter directs air flow through the second opening and over the second shelf. The return duct is positioned above the third shelf and includes a first return opening and a second return opening. The first return opening is in fluid communication with the fan and is positioned proximate a front end of the shelf. The second opening is in fluid communication with the fan and is positioned proximate the rear end of the shelf.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," and "having" and variations thereof herein is meant to encompass the items listed thereafter and equivalents thereof as well as additional items.

DETAILED DESCRIPTION

Figure 1:
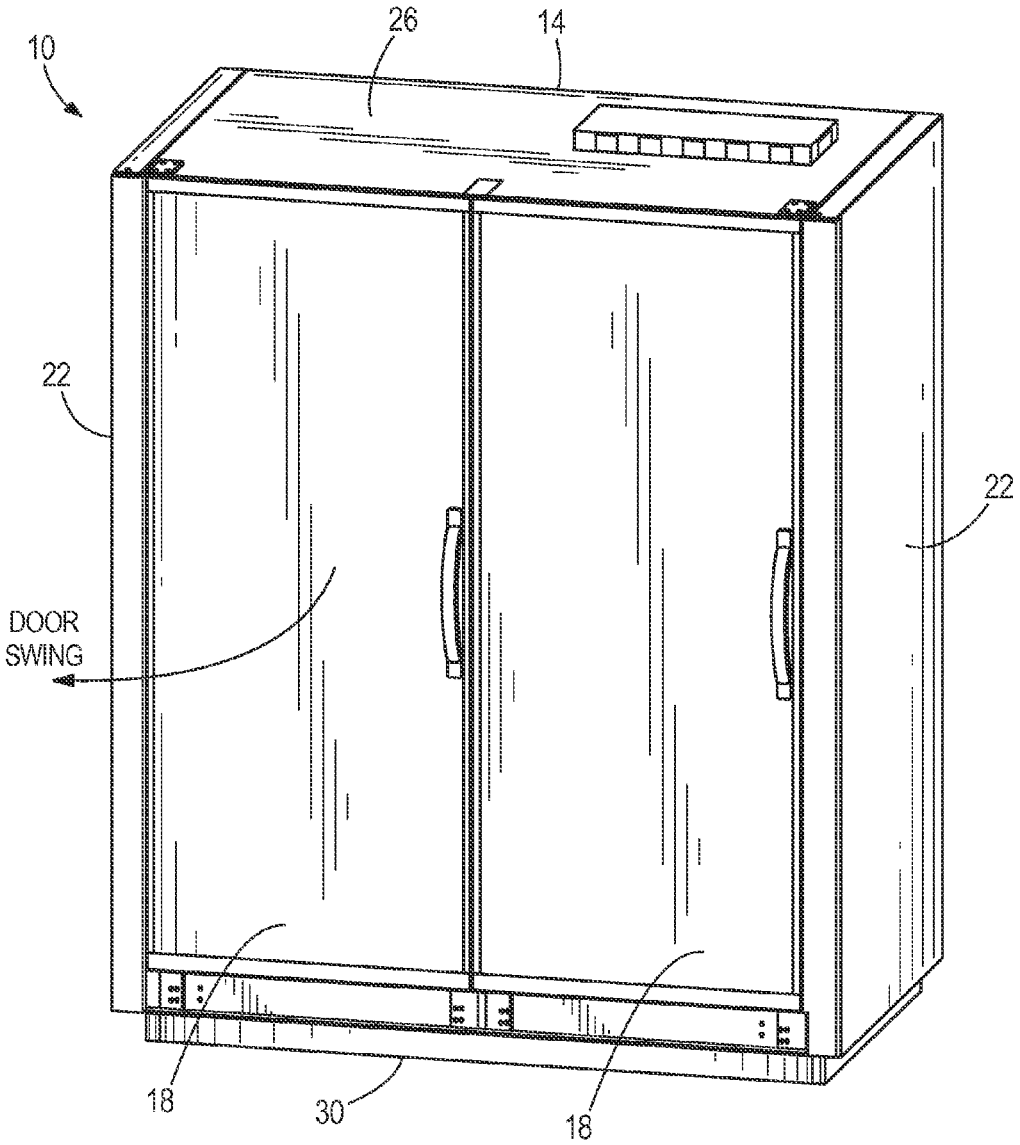
FIG. 1 is a perspective view of a refrigeration case.

FIG. 1 shows a refrigeration case 10 including a rear wall 14, a pair of doors 18 opposite the rear wall 14, a pair of side walls 22, a top 26, and a bottom 30, and these components define an interior chamber. The doors 18 swing open to provide access to the contents of the interior chamber of the case 10. In other embodiments, the case 10 may include fewer or more doors 18 or may include sliding doors.

Figure 2:
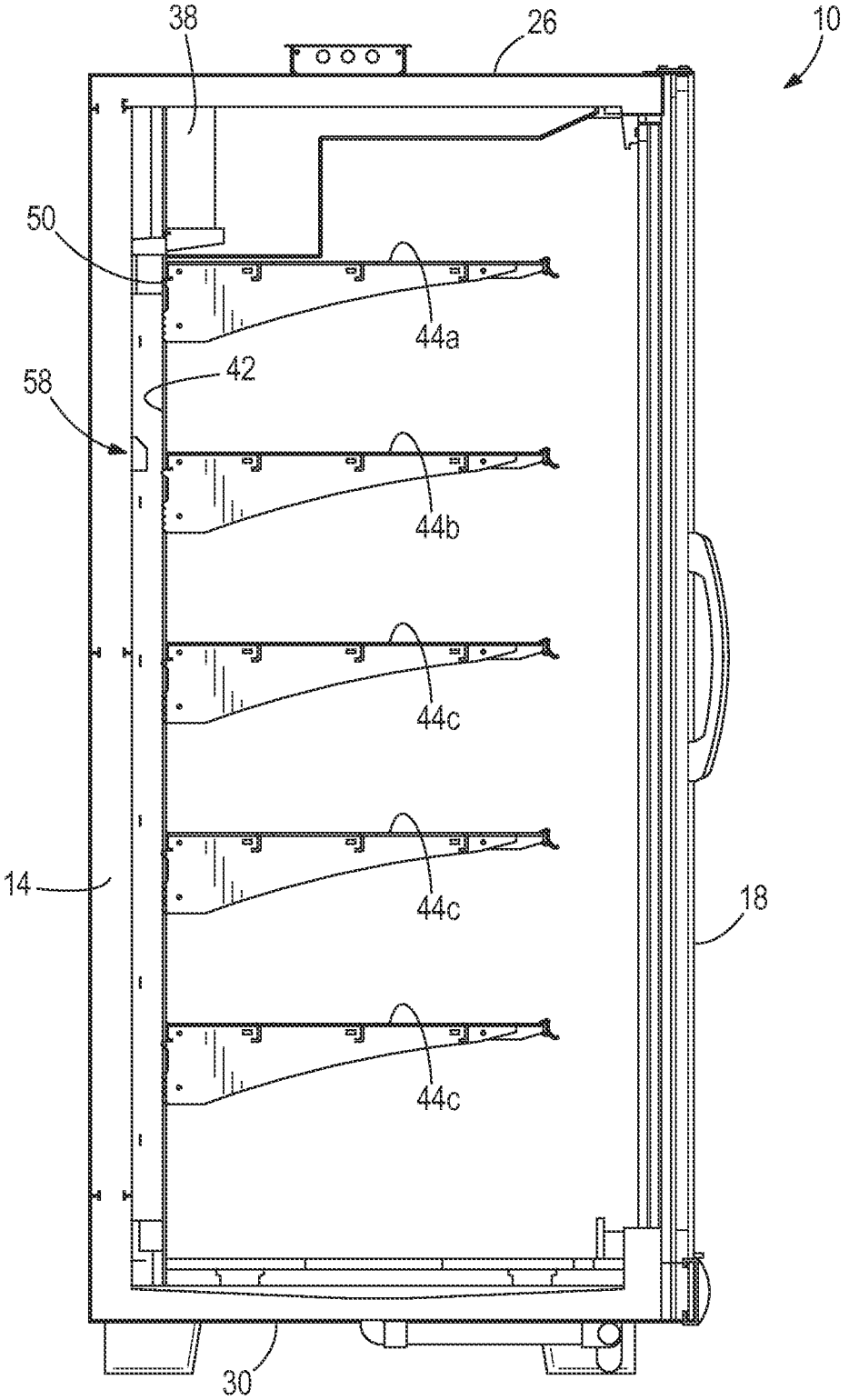
FIG. 2 is a right side view of the refrigeration case of FIG. 1 with a right wall removed.
Figure 3:
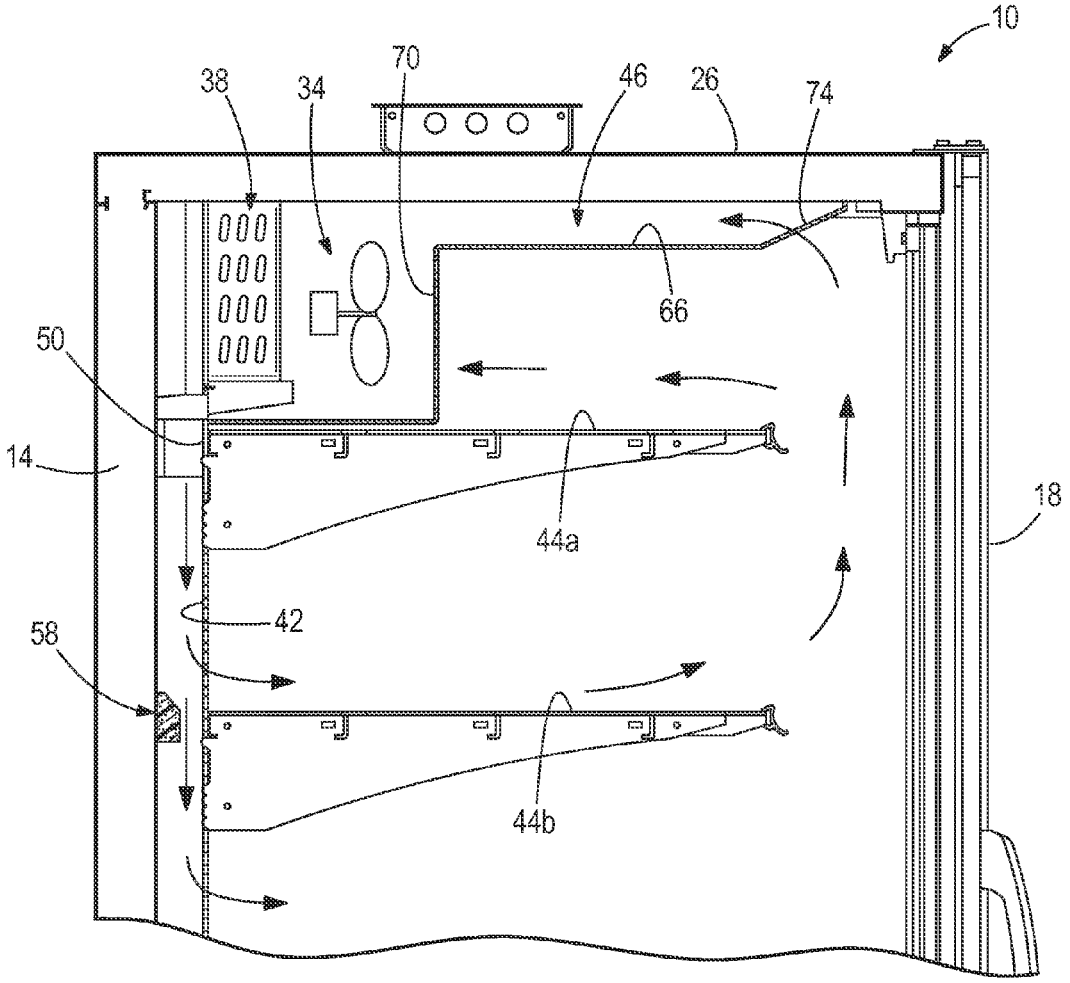
FIG. 3 is an enlarged right side view of a portion of the case of FIG. 2.
Figure 4:
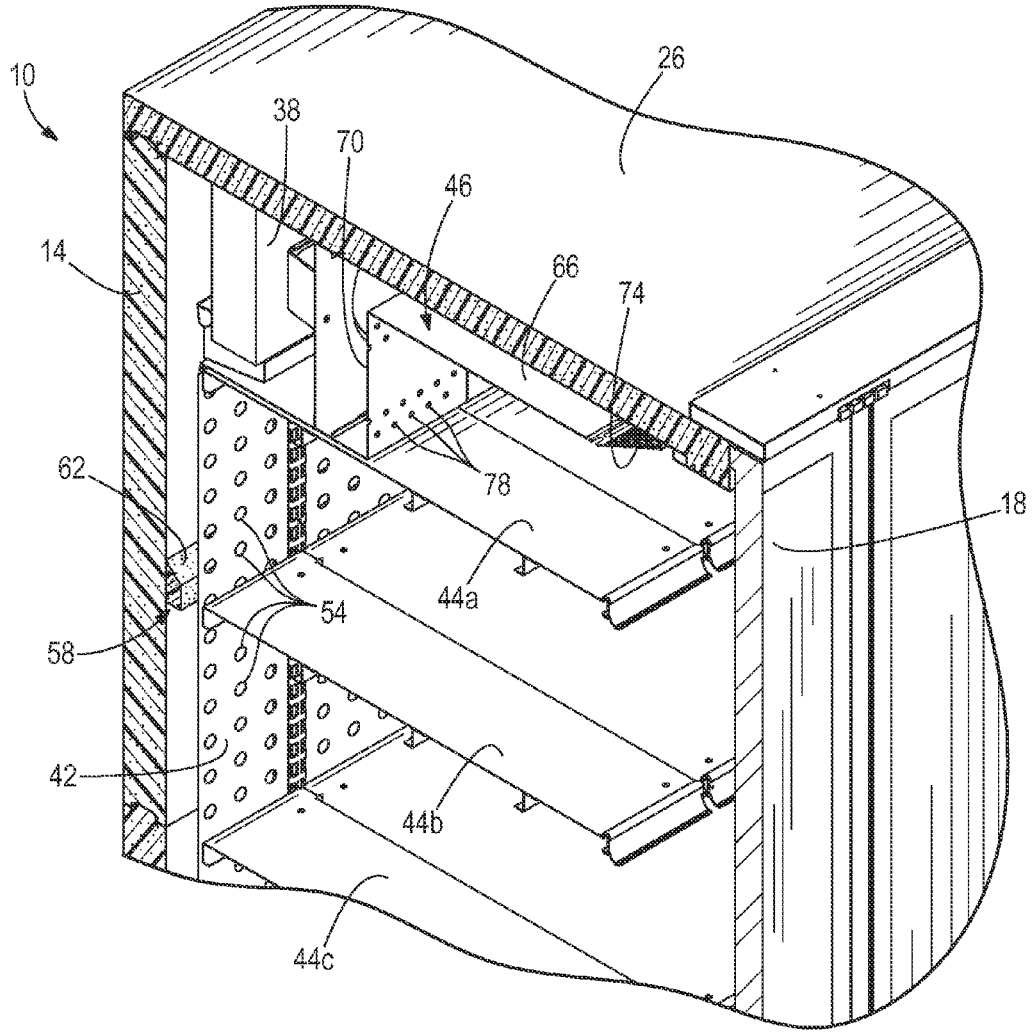
FIG. 4 is a perspective view of the portion of the case of FIG. 3.

As shown in FIGS. 2-4, the case 10 further includes a fan 34 (FIG. 3), an evaporator coil 38, an air duct wall 42, and multiple shelves 44 positioned in a stacked configuration between the air duct wall 42 and the front door 18. The air duct wall 42 extends from an upper portion of the case 10 toward the bottom 30 (FIG. 2) of the case 10, parallel to the rear wall 14. A space between the air duct wall 42 and the rear wall 14 defines an air flow channel. In the illustrated embodiment, the fan 34 is positioned adjacent a return duct 46 (FIG. 3) proximate a top shelf 44*a* of the case 10. The coil 38 is positioned in an upper portion of the case 10, between the fan 34 and an inlet 50 of the air flow channel.

As shown in FIG. 4, multiple openings 54 are spaced apart along the length and width of the air duct wall 42 to allow air to flow from the air flow channel, through the air duct wall 42 and over product (not shown) supported on the shelves 44. In one embodiment, the air duct wall 42 includes a set of openings 54 positioned between each shelf 44 (e.g., a first set of openings positioned above the shelf 44*b* but below the shelf 44*a*, a second set of openings positioned between the shelf 44*b* and the shelf 44*c*, etc.).

In addition, a flow diverter or parabolic diffuser or wedge 58 is positioned in the air flow channel. The wedge 58 has a slanted surface 62 forming an acute angle with respect to the air duct wall 42. The slanted surface 62 faces the air inlet 50 in order to reduce the pressure drop of the air flowing over the wedge 58. In the illustrated embodiment, the wedge 58 is coupled to the rear wall 14 and is positioned opposite a portion of the air duct wall 42 proximate an upper shelf 44*b*. The angled surface 62 is positioned above the shelf 44*b*, thereby constricting flow in the air flow channel past the shelf 44*b*. As a result, cool air flow is directed through the openings 54 and over the shelf 44*b*. In one embodiment, the wedge 58 is made of a foam material, such as expandable polystyrene (EPS).

Figure 5:
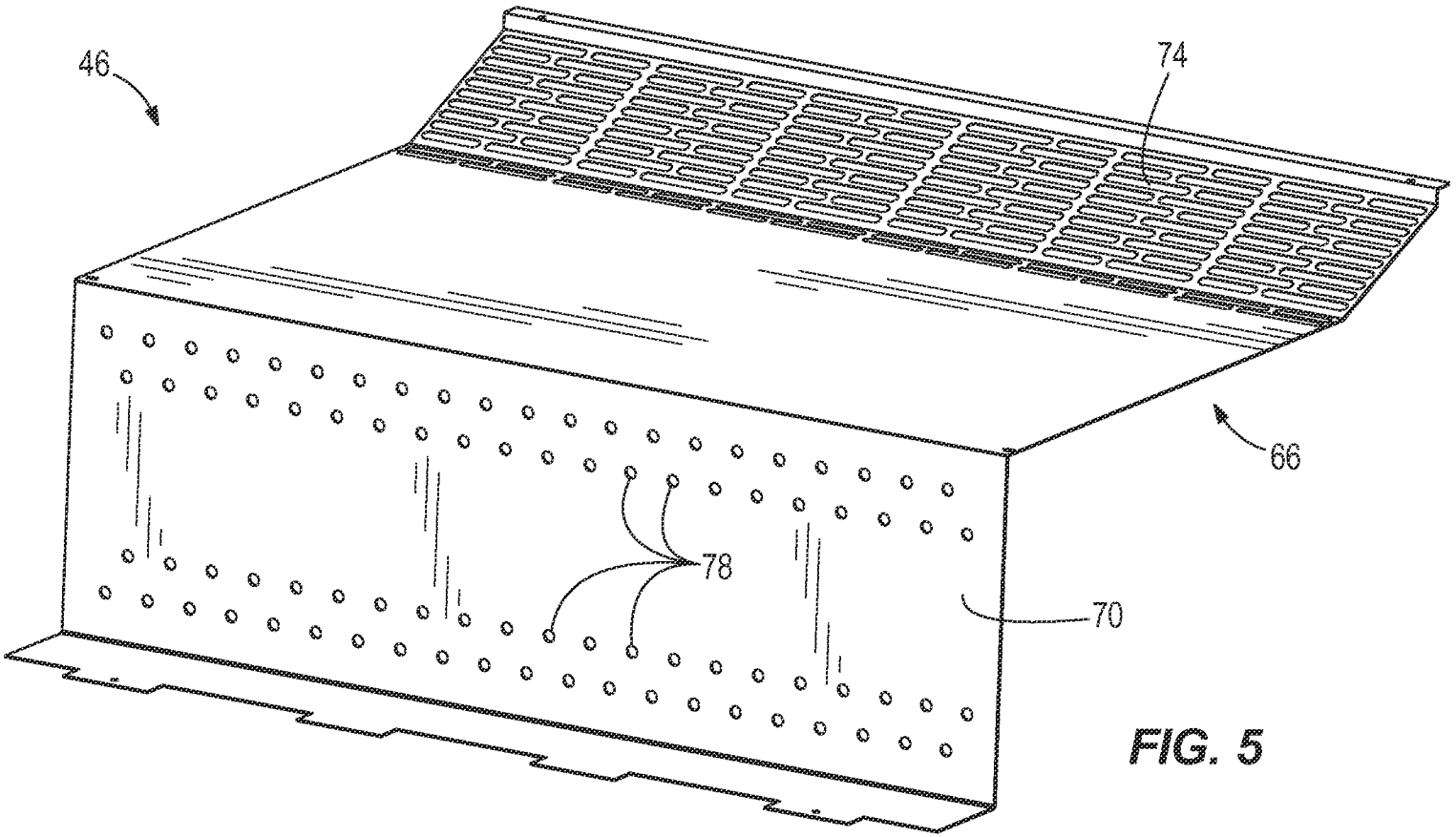
FIG. 5 is a perspective view of a fan housing.

Referring to FIGS. 3 and 4, the return duct 46 includes a first portion or ceiling 66 and a second portion or wall 70. The ceiling 66 provides a false ceiling adjacent the inside of the top 26 and forming a flow channel between the top 26 and the ceiling 66. The ceiling 66 also includes openings forming a grill 74 positioned proximate the front of the case 10. The wall 70 is positioned behind the grill 74 (i.e., proximate the rear of the shelf 44*a*, behind the product supported by the top shelf 44*a*), and includes multiple openings 78 (FIG. 4). In the illustrated embodiment, the wall 70 is substantially vertical and the grill 74 is slanted such that the grill 74 is oriented at an acute angle with respect to the top 26 of the case 10. FIG. 5 shows the return duct 46 in further detail.

Referring now to FIG. 3, the fan 34 draws air through the grill 74 and openings 78 of the return duct 46. The fan 34 pushes the air over the coil 38 and into the air flow channel. The air is cooled as it passes over the coil 38. As the air passes through the air flow channel, the air is directed through the openings 54 (FIG. 4) of the air duct wall 42 and over the shelves 44*b* and 44*c* to cool any products supported on the shelves 44*b* and 44*c*. In particular, the wedge 58 "squeezes" the air in a portion of the air flow channel and acts like a weir, thereby reducing or metering a portion of the air in the area in front of the wedge 58. This metering action diverts a portion of the air flow through the openings 54 and onto an upper shelf 44*b*. Thus, a larger portion of cool air flows over the upper shelf 44*b* than if the wedge 58 was not present. The remaining air flows around the wedge 58 and passes over the lower shelves 44*c*.

After the cool air flows over the shelves 44*b* and 44*c*, the warmed air is drawn by the suction of the fan 34 to the return duct 46. A portion of the air passes through the grill 74 and into the channel formed between the ceiling 66 and the top 26. Another portion of the air flows over the product on the top shelf 44*a* and through the openings 78 (FIG. 4) in the wall 70 of the return duct 46.

The openings 78 in the wall 70 increase the flow of cool air over the warmest products in the case 10 (i.e., the product on the top shelf 44*a*). The increased air flow cools the products in the case 10 more efficiently and reduces temperature variations between the products on the lower shelves 44*c* and the products on the top shelf 44*a*. In addition, the openings 78 permit a greater volume of air to be discharged through the fan 34 near the top 26 of the case 10, eliminating the dead space beneath the ceiling 66. In one embodiment, the increased air flow over the top shelf 44*a* and the increased air flow over the upper shelf 44*b* through the air duct wall 42 results in a temperature reduction of the product on those shelves 44*a* and 44*b* by approximately 1-2 degrees Fahrenheit.

Thus, the invention provides, among other things, an air duct for a refrigeration case. Although the invention has been described in detail with reference to certain preferred embodiments, variations and modifications exist within the scope and spirit of one or more independent aspects of the invention as described.

The invention claimed is:

1. A refrigeration case comprising:

a housing including a top wall and a rear wall, the housing defining an interior chamber having an upper portion and a lower portion;

a door movably coupled to the housing opposite the rear wall, the door operable to selectively open and close the interior chamber;

a first shelf positioned proximate the lower portion of the interior chamber;

a second shelf positioned above the first shelf; and a substantially planer duct wall positioned proximate the rear wall and extending between the upper portion of the interior chamber and the lower portion of the interior chamber, the duct wall at least partially defining a flow channel extending between at least the first shelf and the second shelf, the duct wall including a first opening above the first shelf and a second opening above the second shelf;

a fan for providing cool air flow, the fan in fluid communication with the flow channel; and a diverter positioned in the flow channel proximate the second shelf and downstream of the second opening, the diverter directing air flow through the second opening and over the second shelf, wherein the diverter is coupled to the rear wall opposite the duct wall wherein a gap is defined between the substantially planar duct wall and the diverter.

2. The refrigeration case of claim 1, wherein the fan is positioned proximate the top wall.

3. The refrigeration case of claim 1, wherein the diverter is a parabolic diffuser.

4. The refrigeration case of claim 1, wherein the diverter constricts the air flow just above the second shelf, thereby forcing a portion of the air flow through the second opening.

5. The refrigeration case of claim 1, wherein the diverter includes a surface facing toward an inlet of the flow channel, the surface forming an acute angle with respect to the duct wall.

6. The refrigeration case of claim 1, further comprising a return duct including a first return opening in fluid communication with the fan and a second return opening in fluid communication with the fan, the second return opening positioned closer to the rear wall than the first return opening.

7. The refrigeration case of claim 6, wherein the first return opening is positioned proximate the top wall, and the second return opening is positioned below the first return opening.

8. A refrigeration case comprising:

a housing including a top wall and a rear wall, the housing defining an interior chamber;

a door movably coupled to the housing opposite the rear wall, the door operable to selectively open and close the interior chamber;

a fan for providing cool air flow;

a shelf positioned within the interior chamber proximate the top wall, the shelf including a front end proximate the door and a rear end positioned away from the door;

a flow channel having an inlet in fluid communication with the fan, the flow channel circulating air flow within the interior chamber;

a return duct positioned above the shelf and including a first portion and a second portion, the first portion including a first return opening in fluid communication with the fan and positioned proximate the front end of the shelf, the second portion including a second opening in fluid communication with the fan and positioned proximate the rear end of the shelf, the first return opening and the second return opening providing fluid communication between the flow channel and the return duct, wherein the first portion forms an acute angle relative to the top wall of the interior chamber, and wherein the second portion is substantially perpendicular to the top wall a substantially planar duct wall positioned proximate the rear wall, said duct wall at least partially extending between a first shelf and a second shelf above the first shelf, said duct wall including a first opening above the first shelf and a second opening above the second shelf, a diverter positioned in the flow channel proximate the second shelf and downstream of the second opening, the diverter directing airflow through the second opening and over the second shelf, wherein the diverter is coupled to the rear wall opposite the duct wall, wherein a gap is defined between the substantially planer duct wall and the diverter.

9. The refrigeration case of claim 8, wherein the second return opening is positioned below the first return opening to facilitate air flow over the shelf.

10. The refrigeration case of claim 8, wherein the flow channel directs flow toward a bottom wall of the interior chamber, and wherein the flow channel includes a diverter for directing flow over a second shelf positioned above the bottom wall.

11. The refrigeration case of claim 10, wherein the diverter constricts the air flow just above the second shelf, thereby forcing a portion of the air flow over the second shelf.

12. The refrigeration case of claim 10, wherein the diverter includes a surface facing toward an inlet of the flow channel and the surface forms an acute angle with respect to the rear wall.

13. A refrigeration case comprising:

a housing including a top wall and a rear wall, the housing defining an interior chamber having an upper portion and a lower portion;

a door movably coupled to the housing opposite the rear wall, the door operable to selectively open and close the interior chamber;

a first shelf positioned proximate the lower portion of the interior chamber;

a second shelf positioned above the first shelf;

a third shelf positioned above the second shelf;

a fan for providing cool air flow, the fan positioned proximate the top wall;

a substantially planer duct wall positioned proximate the rear wall and at least partially defining a flow channel extending between at least the first shelf and the second shelf, the duct wall including a first opening above the first shelf and a second opening proximate the second shelf;

a diverter positioned in the flow channel above the second shelf, the diverter directing air flow through the second opening and over the second shelf, the diverter coupled to the rear wall opposite the duct wall; and wherein a gap is defined between the substantially planer duct wall and the diverter a return duct positioned above the third shelf, the return duct including a first return opening and a second return opening, the first return opening in fluid communication with the fan and positioned proximate a front end of the shelf, the second return opening in fluid communication with the fan and positioned proximate the rear end of the shelf, wherein the first return opening and the second return opening provide fluid communication between the flow channel and the return duct.

14. The refrigeration case of claim 13, wherein the second return opening is positioned below the first return opening to facilitate air flow over the third shelf.

15. The refrigeration case of claim 13, wherein the diverter is downstream of the second opening and constricts the air flow just above the second shelf, thereby forcing a portion of the air flow over the second shelf.

16. The refrigeration case of claim 13, wherein the diverter includes a surface facing toward an inlet of the flow channel and the surface forms an acute angle with respect to the rear wall.

17. The refrigeration case of claim 13, wherein the return duct includes a first portion and a second portion, the first portion including the first return opening and the second portion including the second return opening, the first portion forming an acute angle relative to the top wall, the second portion being substantially perpendicular to the top wall.

* * * * *